US005563026A

United States Patent [19]

Singer

[11] Patent Number: 5,563,026

[45] Date of Patent: Oct. 8, 1996

[54] COLOR NEGATIVE ELEMENT HAVING IMPROVED GREEN RECORD PRINTER COMPATIBILITY

[75] Inventor: Stephen P. Singer, Spencerport, N.Y.

[73] Assignee: Eastman Kodak Company, Rochester, N.Y.

[21] Appl. No.: 431,243

[22] Filed: Apr. 28, 1995

[51] Int. Cl.[6] ..... G03C 1/46

[52] U.S. Cl. ..... 430/504; 430/506; 430/555; 430/359; 430/387

[58] Field of Search ..... 430/504, 506, 430/555, 543, 386, 387, 359

[56] References Cited

U.S. PATENT DOCUMENTS

| | | | |
|---|---|---|---|
| 4,952,487 | 8/1990 | Renner et al. | 430/555 |
| 4,977,072 | 12/1990 | Renner et al. | 430/555 |
| 5,238,797 | 8/1993 | Hirabayashi et al. | 430/508 |
| 5,447,831 | 9/1995 | Singer et al. | 430/504 |
| 5,455,150 | 10/1995 | Mooberry et al. | 430/504 |

FOREIGN PATENT DOCUMENTS

| | | |
|---|---|---|
| 584793 | 3/1994 | European Pat. Off. . |
| 63-61247 | 3/1988 | Japan . |

*Primary Examiner*—Geraldine Letscher
*Attorney, Agent, or Firm*—Arthur E. Kluegel

[57] ABSTRACT

The invention provides a multicolor negative photographic element comprising a support bearing at least two green light sensitive silver halide emulsion layers of differing light sensitivity, the least and only the least sensitive layer containing a 1-phenyl-3-acylamino-4-nitrogenheterocycle-pyrazolin-5-one dye forming hue correction coupler which reacts with oxidized developer during development to form a dye having a D580/D550 ratio greater than that exhibited by the element absent the hue correction coupler. The invention also provides an imaging process.

12 Claims, No Drawings

COLOR NEGATIVE ELEMENT HAVING IMPROVED GREEN RECORD PRINTER COMPATIBILITY

FIELD OF THE INVENTION

This invention relates to a multicolor negative photographic element comprising a support bearing at least two green light sensitive silver halide emulsion layers of differing light sensitivity, the least and only the least green sensitive layer containing a 1-phenyl-3-acylamino-4- nitrogenheterocyclic-pyrazolin-5-one dye forming hue correction coupler which reacts with oxidized developer during development to form a dye having a D580/D550 ratio greater than that exhibited by the element absent the hue correction coupler. The presence of the hue correction coupler provides enhanced green record printer compatibility while maintaining acceptably low levels of sensitivity to developer pH variations and desirable latitude.

BACKGROUND OF THE INVENTION

The color negative-positive photographic system relies on the exposure of a scene onto a color negative film. The exposed negative is then projected onto a negative-working color photographic paper to form, after development, the desired positive image. In order to correctly expose the photographic paper, the average density of the negative in all three color records (red, green and blue) must be measured so that the exposure time and balance between the amounts of the red, green and blue light used to expose (print) the paper can be adjusted.

The general practice in the photofinishing industry is to scan the average color density of the negative using red, green and blue filters. There is no uniform standard for these filters. Different sets of filters may read the same negative differently because of variations in the amount of light they see. In most cases, this is not a problem since the response of a printer filter set is accounted for in the calculation of the subsequent exposure of the paper. However, this method assumes that the measured red, green and blue densities of any and all negatives, as read by a particular printer system, reflect the actual color densities in each negative.

Color negative films are considered to be "printer compatible" on a particular printer, if they yield final photographic prints with acceptable color balance differences for any given scene. It is desirable in the photofinishing industry to always produce prints that are correct in color balance regardless of the type or composition of the negative film or their average neutral exposure. In order to accomplish this, it would be required that all negatives give equal response in density, as read by both the printer (using its filter set) and the photographic paper onto which the negative will be printed. It follows that it would then be necessary to have all negatives give identical density on a wavelength-by-wavelength basis through the entire exposure scale from Dmin to maximum exposure.

In practice, this does not occur. There are variations in the wavelength-by-wavelength density (spectrophotographic) response of different negatives as seen by the photofinishing trade. Negatives from different commercial sources may use entirely different couplers which have different spectrophotographic responses. In addition, couplers may undergo aggregration and other hue shifting phenomena as a function of exposure, thus causing shifts in density at any particular wavelength of the negative throughout the exposure scale. Moreover, it is common that different couplers of the same general hue but not identical hue are used in a single color record. For example, a typical layer may consist of an image coupler and an image modifier which form different dyes of the same general class. If the different dyes that are formed are not identical, then shifts in overall hue can occur as a function of exposure due to differences in activity between the various couplers. Finally, different levels of stains or unwanted sources of color can be retained, formed or introduced into the film during processing depending on the components of the film and so, different negatives will vary from each other.

Pyrazolotriazoles have been used as magenta couplers in commercially available color negative films and can offer useful photographic advantages depending on format, even though they have high pH sensitivity and complicated syntheses. The hues of the magenta dyes formed from pyrazolotriazoles are broad in terms of bandwidth, with substantial density at wavelengths from 565 to 600 nm. A typical example of a pyrazolotriazole coupler is Coupler A shown in the experimental section.

Four equivalent couplers (those that contain only hydrogen atoms at the coupling site) such as 1- phenyl-3-acylamino-5-pyrazolones have also been used as magenta couplers in commercially available color negative films and can offer useful photographic advantages depending on format, even though they suffer from low coupling efficiency and sensitivity to formaldehyde. The hues of the magenta dyes formed from 1-phenyl-3-acylamino-5-pyrazolones are broad in terms of bandwidth, with substantial density at wavelengths from 560 to 590 nm, similar to pyrazolotriazole based dyes. Typical examples of four equivalent 1-phenyl-3-acylamino-5-pyrazolones are Couplers B and D shown in the experimental section.

A particularly preferred type of two equivalent 1-phenyl-3-acylamino-5-pyrazolone magenta image coupler is the type that contains a nitrogen based heterocyclic coupling-off group as described in U.S. Pat. Nos. 4,241,168; 4,076,533, 4,220,470, 4,367,282, 3,617,291, 4,301,235 and U.S. Pat. No. 4,310,619. However, these 4-nitrogen heterocycle-1-phenyl-3-acylamino-5-pyrazolone couplers are extremely reactive towards oxidized developer which leads to high green Dmin and poor inhibitibility when used solely as magenta image couplers. The dyes generated from these 2-equivalent couplers are identical to those formed from the corresponding 4-equivalent couplers.

1-Phenyl-3-anilino-5-pyrazolones are also used as magenta couplers in commercially available color negative films and can offer useful photographic advantages such as low pH sensitivity, high coupling efficiency and ease of synthesis. However, the hues of the magenta dyes formed from 1-phenyl-3-anilino-5-pyrazolones are narrower in bandwidth than those formed from pyrazolotriazoles or 1-phenyl-3-acylamino-5-pyrazolones, with much less density at wavelengths from 565 to 600 nm. A typical example of this type of coupler is Coupler C shown in the experimental section.

Although the foregoing numbers may vary depending on the particular color developer used, for most color developers they will be within a few nanometers. In the present application, all of the wavelength measurements given are with reference to development of the element with 2-[(4-amino-3-methyl phenyl)ethylamino]ethanol, as typically used in the industry for development of negative films as in KODAK FLEXICOLOR II Process (British Journal of Photography Annual, 1988, pp 196–198). It should be noted that it is highly desirable for a magenta image dye to have its maximum absorbance at less than 560 nm in order to match the maximum green sensitivity of photographic paper. All of the coupler classes above as well as the specific couplers described in the experimental (including the hue correction couplers of the invention) give dyes that have their maximum absorbance at less than 560 nm.

Thus, negative films using each of the above types of magenta couplers can be prepared so that the red, green (measured at one wavelength, i.e. 550 nm) and blue densities are matched. Because photographic paper has a narrow peak sensitivity range of 545–555 nm and low sensitivity at greater than 565 nm, these films would appear equivalent to the paper. However, the film with the 1-phenyl-3-anilino-5-pyrazolone magenta coupler would have less density in the region of 565 to 600 nm than the others. Printers whose green filters do not significantly read densities at wavelengths greater than 565 nm would record all three films as having the same green density. Printers with green filters that read density at wavelengths longer than 565 nm, though, would measure the film containing a 1-phenyl-3-anilino-5-pyrazolone as having less green density than the others. Since the red and blue density determination by the printer are relatively independent of the magenta coupler, such a printer would not give the film containing the 1-phenyl-3-anilino-5-pyrazolone the same exposure as the films with the other magenta couplers. Thus, paper images printed from a film containing 1-phenyl-3-anilino-5-pyrazolone magenta coupler would not have the same color balance on this type of printer as films containing either of the other two types of magenta couplers. For example, commercially used printers such as KODAK Printer Models 2610 or 3510 have green filters that do not read significant amounts of density at greater than 565 nm and so are not as sensitive to magenta dye absorbance differences in the 565–600 nm range. However, other commercially available printers such as the KODAK Model 312 or Class 35 Printers, AGFA MSP Printer or the NORITSU 1001 Minilab have green filters that will also read films with these different classes of couplers as different in overall green density.

In order to get color prints with matched color balance from a wide selection of films that contain these different couplers when using printers that read significant amounts of density from 565 to 600 nm, photofinishers must either segregate the different films so that the correct calculation of the exposure for that particular film can be made, or manually adjust the color balance during the printing operation. These operations are undesirable, leading to higher operating costs, decreased printer output and increased chance of operator error.

It would be desirable to have color negative films containing 1-phenyl-3-anilino-5-pyrazolone magenta couplers or other couplers which produce a magenta image dye with low density in the 565 to 600 nm range, which can be printed in different printers without segregating them from other films or manually adjusting color balance, and still obtain paper prints with good color balance.

Both U.S. Patent application Ser. No. 08/075,068, now U.S. Pat. No. 5,455,150, and U.S. Pat. No. 5,238,797 describe the use of photographically inert colorants or dyes with peak absorbance of 560–590 nm to improve the printer compatibility between multilayer films that contain magenta image dyes with low absorbance between 560–590 nm with film containing other types of magenta dyes. However, this improvement method is limited because the correction is not imagewise. The amount of density between 560–590 nm provided by the inert dye is fixed and constant throughout the exposure scale. At high exposures (high amounts of magenta dye), the amount of correction will be insufficient, whereas at low exposures (low amounts of magenta dye), the correction will be excessive. Only at one point in the exposure scale will the degree of correction be ideal.

U.S. Patent application Ser. No 08/139,238, now U.S. Pat. No. 5,447,831, filed Oct. 19, 1993 describes the use of a hue correction coupler which gives a dye after development with maximum absorbance >560 nm to improve printer compatiblity. Such couplers have the advantage of providing imagewise correction. However, such hue correction couplers also cause some increases in the unwanted red density of the magenta layer and often have insufficent coupling activity to cause the desired degree of correction without degrading other properties of the film such as latitude and process sensitivity.

Japanese Application (Kokai) 63-61247 describes the use of polymeric two equivalent 4-nitrogen heterocycle-1-phenyl-3-acylamino-5-pyrazolone couplers together with 4-thio-1-phenyl-3-anilino-5-pyrazolone couplers in all green sensitive layers without regard to relative light sensitivity of the layer. As elsewhere described, inclusion of the hue correction coupler in the more sensitive layers distorts the desired effect of image modifying development inhibitor couplers because the hue correction coupler is so fast acting that its extent of coupling is extremely difficult to inhibit.

EP Application 0 584 793 A1 describes certain pyrazolotriazole magenta image couplers which are deficient in printer compatibility. The EP application suggests certain types of pyrazolotriazole magenta image couplers as image couplers which have a nucleus which is better in this respect.

A problem to be solved is to provide a photographic element which although it employs a magenta image dye-forming coupler which coupler is defficient in density at greater than 565 nm, the element exhibits improved green record printer compatibility without sacrificing developer process sensitivity or latitude.

SUMMARY OF THE INVENTION

The invention provides a multicolor negative photographic element comprising a support bearing at least two green light sensitive silver halide emulsion layers of differing light sensitivity, the least and only the least green sensitive layer containing a 1-phenyl-3-acylamino-4-nitrogenheterocyclic-pyrazolin-5-one dye forming hue correction coupler which reacts with oxidized developer during development to form a dye having a D580/D550 ratio greater than that exhibited by the element absent the hue correction coupler. The invention also provides an imaging process.

The invention provides a photographic element which, although it employs a magenta image dye-forming coupler which coupler is deficient in density at greater than 565 nm, the element exhibits improved green record printer compatibility without sacrificing developer process sensitivity or latitude.

DETAILED DESCRIPTION OF THE INVENTION

The foregoing objective can be obtained in films having a color coupler which produces a magenta image dye with low density in the 565 to 600 nm range, by additionally providing in the least light sensitive magenta dye forming record of the indicated pyrazolone coupler. As a result, the green density of such films appears to printers with green filters that read density at wavelengths longer than 565 nm, to be more like films containing pyrazolotriazole or 1-phenyl-3-acylamino-5-pyrazolone magenta image couplers. Thus, such films of the present invention are more compatible during printing operations on any printer, together with films containing other classes of magenta couplers. "More compatible" means that films of the invention will give closer responses to films using other magenta couplers as described above (such as pyrazolotriazole magenta couplers) in terms of green density, regardless of the type of printer or green filter used. This in turn insures that the final paper image formed from the different film negatives will be more alike in overall color balance. In addition, the element of the invention also maintains good latitude and low pH sensitivity.

In particular, the present invention provides a silver halide color photographic negative comprising a red sensitive layer containing a coupler which reacts with oxidized color developer to form a cyan dye, a blue sensitive layer containing a coupler which reacts with oxidized color developer to form a yellow dye, and a green sensitive layer containing a color coupler which upon reaction with oxidized color developer forms a magenta image dye. The element additionally comprises a 1-phenyl-3-acylamino-4-nitrogenheterocyclic-pyrazolin-5-one dye forming hue correction coupler so that the negative has a D580/D550 density ratio which is greater than that exhibited by the element absent the hue correction coupler. By D580, D550, D640 and the like, is meant the density at 580 nm, 550 nm, 640 nm and the like, of the film. Unless otherwise indicated, it will be understood that the foregoing and other density values are measured at a "neutral midscale exposure" of the film. For the purposes of this application, neutral midscale exposure refers to a neutral (that is, all three color records) exposure at +0.82 logE exposure units over the ISO speed of the element. This approximates the average density region (often referred to as a midscale exposure) of a correctly exposed negative.

The present invention has particular application in color photographic negatives of the foregoing type wherein D580/D550 of the element at neutral midscale exposure, absent the 1-phenyl-3-acylamino-4-nitrogenheterocyclic-pyrazolin-5-one dye forming coupler, is 0.75 or less (particularly where D580/D550 is 0.60 or less or is even 0.50 or less). The hue correction coupler should provide an increase of D580/D550 of at least 0.01, and preferably at least 0.04 (and more preferably at least 0.10) and must be located in the least sensitive magenta dye forming layer. It is preferred that any increase of D640/D550 of the element at neutral midscale exposure, which is caused by the hue correction, is less than the amount the hue correction coupler increases D580/D550 at neutral midscale exposure.

It is necessary that the hue correction coupler be located in the least sensitive magenta dye forming layer in order to provide the benefits of the invention. Because of their high reactivity towards oxidized developer, this type of coupler resists inhibition and thus renders it difficult to achieve the desired degree of inhibition, particularly from other layers. Thus, if the hue correction coupler is located in the more sensitive layers which comprise the bulk of the image, the degree of color correction and sharpness attainable is adversely affected. In addition, because of the combination of high reactivity and resistance to inhibition, it is necessary to remove silver from those layers to maintain curve shape, thus increasing granularity. However, by locating the hue correction coupler in the least sensitive magenta dye forming layer, these deficiencies are minimized. The least sensitive layer provides detail information only in the highlight areas of the image (close to maximum exposure) which, while critical for overall pleasing reproduction, does not contribute significant image structure (sharpness or granularity) information to the image. Hence, it is important that the least sensitive layer maintain its contrast to provide full latitude even in the presence of inhibitors released from other layers. Morever, the hue differences discussed previously are most noticable in the upper density regions that arise from the least sensitive layer. Only the combination of materials of the invention allow for all of these beneficial effects.

The range of density at 580 nm provided by the 1-phenyl-3-acylamino-4-nitrogenheterocyclic-pyrazolin-5-one coupler should be between 0.001 and 2.0, preferably between 0.005 and 1.0. Typically, the levels for the hue correction coupler would be between about 0.0002 g/m$^2$ to 5 g/m$^2$, or 0.001 g/m$^2$ to 2 g/m$^2$, or more preferably 0.01 to 1 g/m$^2$. Any other type of coupler such as masking couplers, development inhibitor releasing couplers, bleach accelerator releasing couplers, etc. known in the art may also be present along with the hue correction coupler.

The 1-phenyl-3-acylamino-4-nitrogenheterocyclic-pyrazolin-5-one coupler can be incorporated into photographic films of the present invention by any method known in the art, such as oil in water dispersions, polymers, solid particles or latexes such as described in publications identified later in this application. It may also be co-dispersed with another coupler. It should also be appreciated that the peak absorbance of the dye formed may be highly dependent on environment and as such, may be manipulated to give the desired density requirements by appropriate choice of coupler solvent, addenda and dispersion conditions.

The preferred structure of the 1-phenyl-3-acylamino-4-nitrogenheterocyclic-pyrazolin-5-one couplers is shown in FORMULA I.

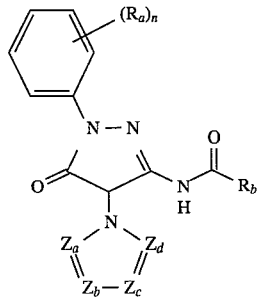

I where:

each $R_a$ is independently a substitutent selected from the group consisting of halogen, cyano, nitro, and trifluromethyl, and from alkylsulfonyl, sulfamoyl, sulfonamido, carbamoyl, carbonamido, alkoxy, acyloxy, aryloxy, alkoxycarbonyl, aryloxycarbonyl, and ureido groups;

n is and integer from 1 to 5;

$R_b$ is selected from the group consisting of alkyl, alkyloxy, aryl, aryloxy and amino groups;

$Z_a$, $Z_b$, $Z_c$, and $Z_d$ are independently a methine group or —N=.

In a preferred example of the hue correction coupler of the invention:

$(R_a)_n$ is 2,5-dichloro or 2,4,6-trichloro;

$R_b$ is a substituted alkyl or aryl group; and $Z_a$ is —N=, and $Z_b$, $Z_c$, and $Z_d$ are unsubstituted methine.

The hue correction coupler compounds can be prepared by procedures known in the art.

As already mentioned, the present invention provides a means to make developed negatives which contain magenta image-dyes with low absorption in the 565–600 nm range relative to magenta dyes formed by pyrazolotriazole or 1-phenyl-3-acylamino-5-pyrazolones, appear more like the latter developed negatives to any printer. Consequently, negatives of the present invention can contain any color coupler or combination of magenta couplers which forms a magenta record with relatively low absorption in the 565–600 nm range upon reaction with oxidized color developer (for example, with a D580/D550 at a neutral midscale exposure of 0.8 or less). Negative elements of the present invention particularly contain as a magenta image dye-forming coupler, a 1-phenyl-3-anilino-pyrazolin-5-one color coupler (either 2 or 4 equivalent). Other classes of magenta image couplers such as a pyrazolotriazole (for example, Coupler A in the Experimental Section) or a 1-phenyl-3-acylamino-pyrazolin-5-one coupler (for example, Coupler B) may also be present in combination with a 1-phenyl-3-anilino-5-pyrazolin-5-one (for example, Coupler C) so long as the density above 565 nm of the magenta record as a whole is still insufficient (for example, with a D580/D550 at a neutral midscale exposure of 0.8 or less) relative to films that contain pyrazolotriazoles and/or 1-phenyl-3-acylamino-5-pyrazolone couplers as the image coupler. Particularly, the 1-phenyl-3-anilino-5-pyrazolone color coupler may be of the same types as described in copending U.S. Patent application Ser. No 08/075,068.

Suitable examples of hue correction couplers of the invention are as follows:

HCC-1:

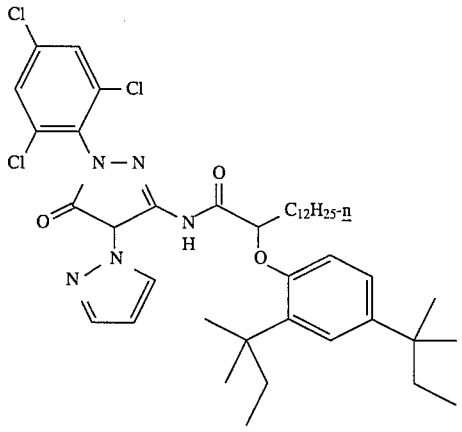

-continued

HCC-2:

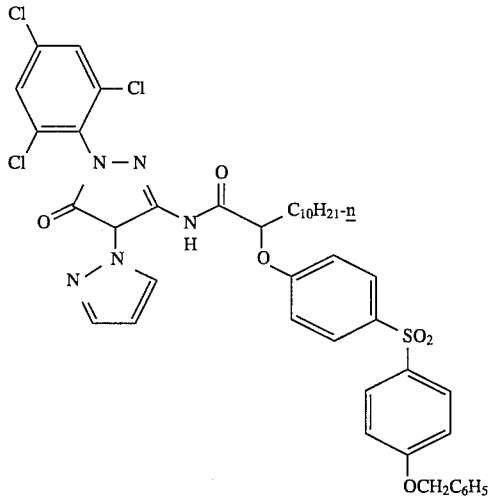

HCC-3:

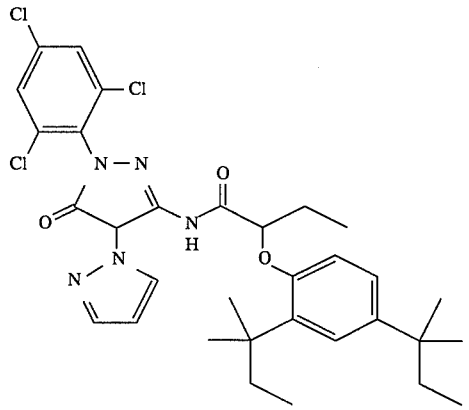

HCC-4:

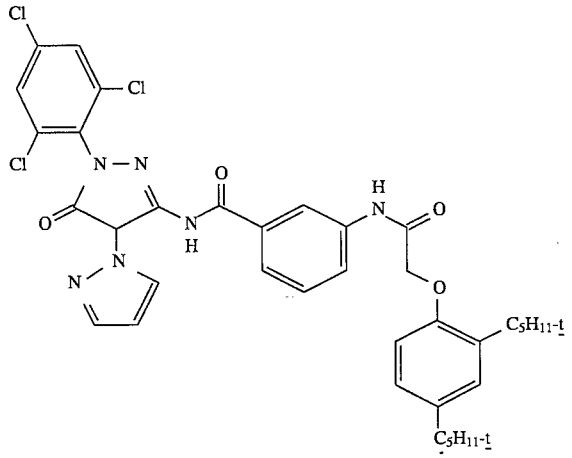

HCC-5:

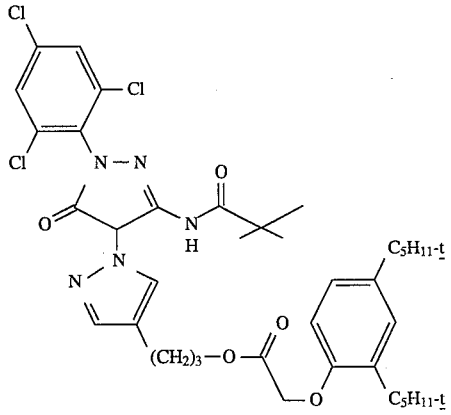

HCC-6:

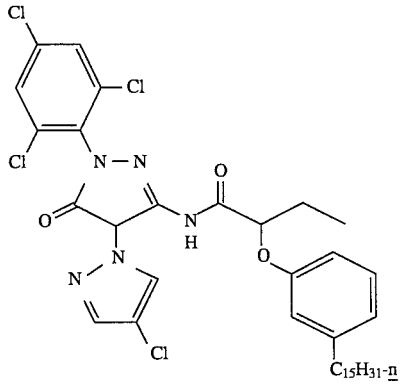

HCC-7:

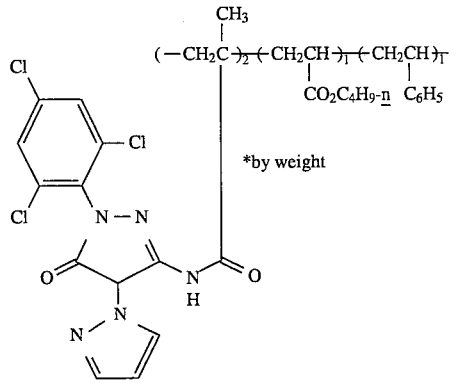

HCC-8:

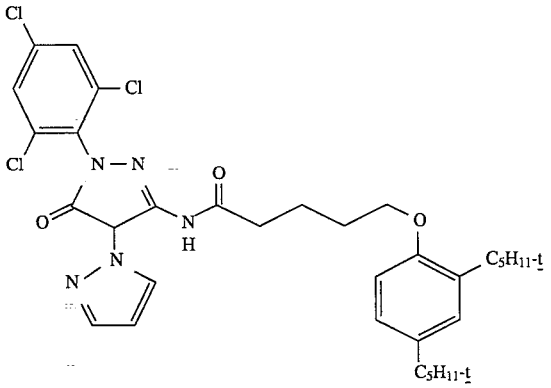

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-pentyl-phenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, 1-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl] sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobic or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure, June* 1994, Item 36230, provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing"

couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

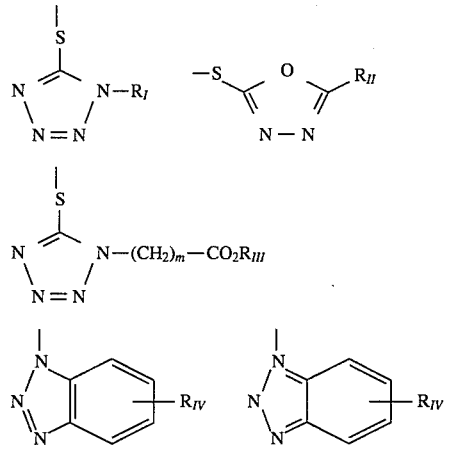

-continued wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

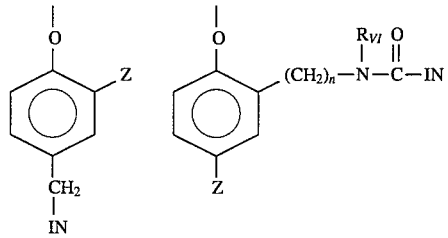

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1
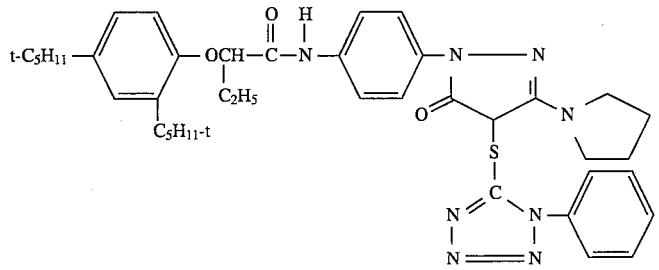
D2
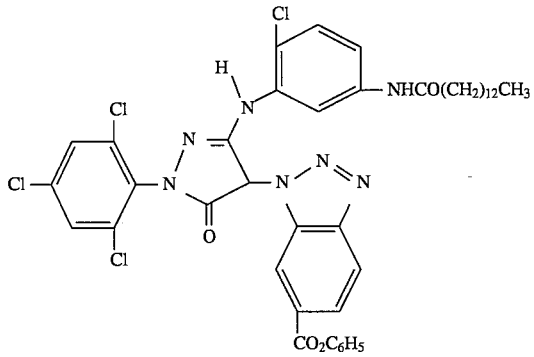
D3
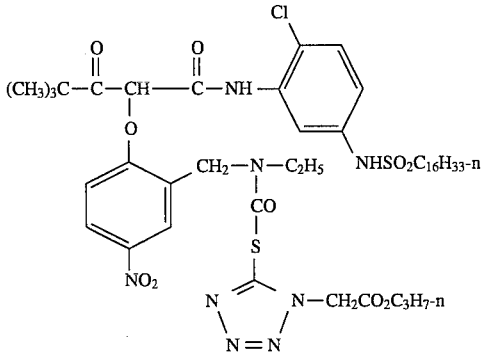
D4
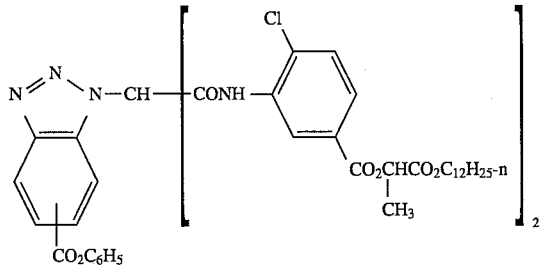
D5
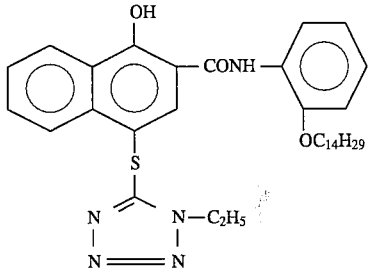
D-6
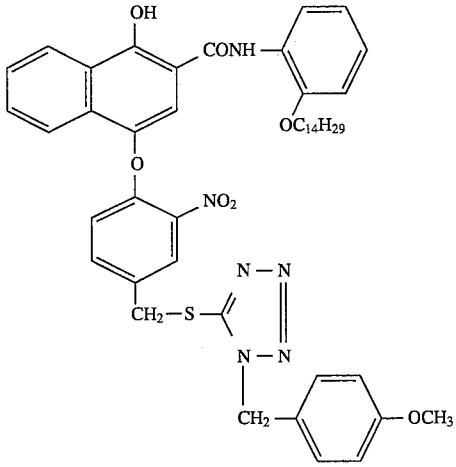
D-7
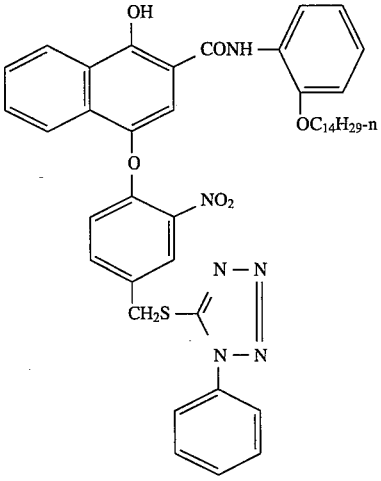

-continued

D8

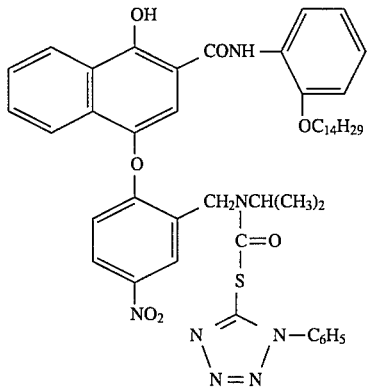

D9

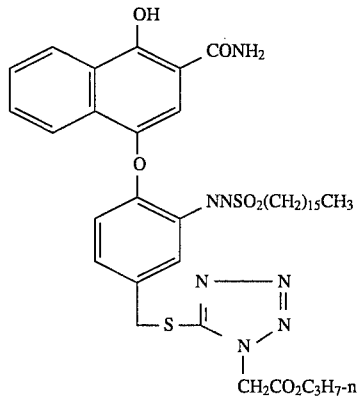

D10

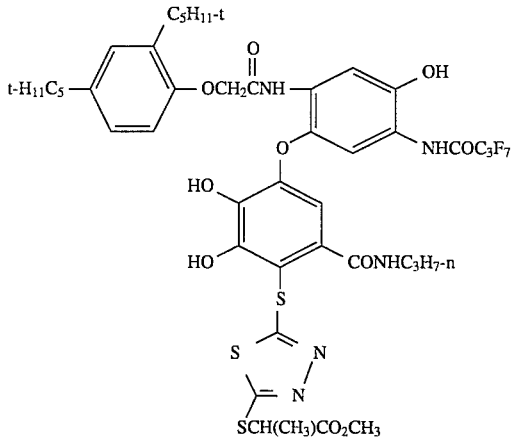

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in *The British Journal of Photography Annual* of 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various patents and other publications cited in this specification are incorporated herein by reference.

EXAMPLES

The invention is illustrated in the following single layer and multilayer examples.

To illustrate the increase in D580/D550, model single layer photographic elements were prepared by coating a cellulose acetate-butyrate clear film support with gelatin at 3.77 g/m$^2$, a green sensitized silver bromoiodide emulsion at 1.08 g/m$^2$ and a magenta image coupler at 40 mmoles/m$^2$ (when coated alone) or at mmoles/m$^2$ when coated with a 1-phenyl-3-acylamino-4-nitrogenheterocyclic-pyrazolin-5-one coupler at 20 mmoles/m$^2$. This layer was then overcoated with a layer containing 2.70 g/m$^2$ of gelatin and bis-vinylsulfonyl methyl ether hardener at 1.75% weight percent based on total gel.

Samples of each element were exposed imagewise through a stepped density test object and subjected to the KODAK FLEXICOLOR (C41) process as described in *British Journal of Photography Annual*, 1988, pp 196–198. Optical density and spectrophotographic measurements were taken at the indicated wavelength and/or exposure values. The ratio of density at 580 nm to density at 550 nm is a measure of the broadening of the magenta hue. The ratio of density at 640 nm to density at 550 nm is a measure of increased unwanted red density of the green layer. In terms of exposure, low refers to measurements taken at density 0.15 above Dmin, medium at density 1.0 above Dmin and high at maximum density. Also measured were gamma (maximum slope between any two density steps) and green Dmax of the process above (developer pH=10 (standard)). Delta Dmax refers to the change in green Dmax between development at pH 10.35 and at pH 9.75 (Delta Dmax= Dmax (10.35)–Dmax (9.75)). Delta Dmax is a measure of the sensitivity of the element to pH variations. Smaller values indicate less sensitivity.

TABLE I demonstrates that the addition of a hue correction coupler such as HCC-1 increases the density of the green record at 580 nm relative to 550 nm in combination with a coupler that forms a dye with insufficient density at 580 nm. However, the addition of other couplers with broad bandwidths outside the scope of the invention (i.e. comparative examples A or B) also served to increase the ratio. This was confirmed by experiments using the KODAK 312 Printer which showed that prints of elements employing the combinations of Coupler C/HCC-1 or C/A (but not C/B) appeared similar to Couplers A or B alone. On the other hand, TABLE II demonstrates that only the inventive combination with the 1-phenyl-3-acylamino-4-nitrogenheterocycle-pyrazolin-5-one coupler of the invention also provides high activity, high Dmax and low sensitivity to developer pH as well.

TABLE I

HUE COMPARISON OF IMAGE COUPLER COMBINATIONS

| | Image | | D580/D550 | | | |
|---|---|---|---|---|---|---|
| Type | Coupler | HCC | Low | Medium | High | D640/D550 |
| Comp | A | — | .787 | .785 | .788 | .065 |
| Comp | B | — | .823 | .814 | .820 | .123 |
| Comp | C | — | .483 | .473 | .485 | .058 |
| Comp | C | A | .728 | .717 | .686 | .058 |
| Comp | C | B | .615 | .594 | .607 | .092 |
| Inv | C | HCC-1 | .683 | .664 | .648 | .118 |

TABLE II

PHOTOGRAPHIC PROPERTIES OF IMAGE COUPLER COMBINATIONS

| Type | Image Coupler | HCC | Gamma* | Dmax* | Delta Dmax |
|---|---|---|---|---|---|
| Comp | A | — | 1.73 | 1.699 | .094 |
| Comp | B | — | 0.72 | 0.910 | .218 |
| Comp | C | — | 2.05 | 1.962 | .143 |
| Comp | C | A | 2.07 | 1.951 | .100 |
| Comp | C | B | 1.38 | 1.435 | .161 |
| Inv | C | HCC-1 | 2.50 | 1.943 | .004 |

*Developer pH = 10.

The formulas for the couplers used in the examples are as follows:

EXAMPLE ML-1 (COMPARISON)

A:

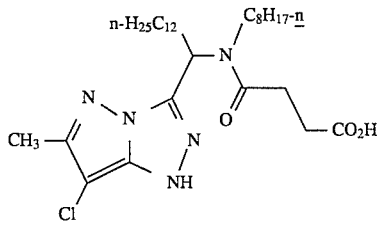

B:

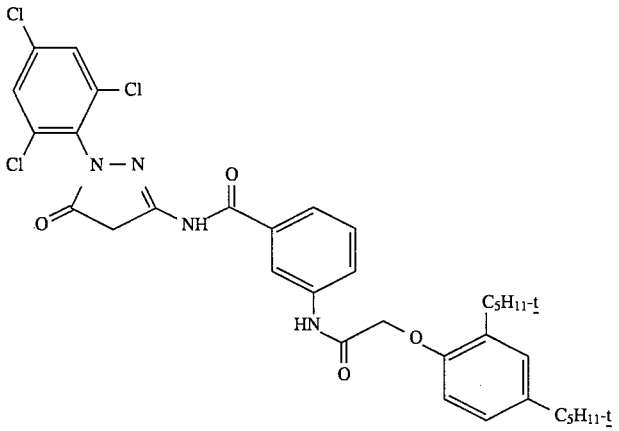

C:

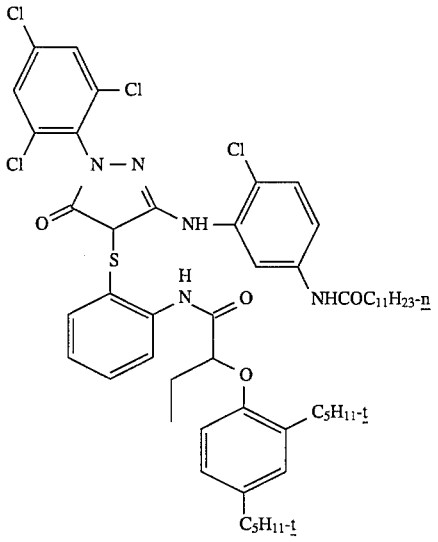

A multi-layer photographic element was produced by coating the following layers on a cellulose triacetate film support (coverages are in grams per meter squared, emulsion sizes are determined by the disc centrifuge method and are reported in Diameter×Thickness in microns); Layer 1 (Anti-halation layer): black collodial silver sol at 0.140; gelatin at 2.15; OxDS-1 at 0.108, UV-1 at 0.075, UV-2 at 0.032, DYE-1 at 0.049; DYE-2 at 0.017 and DYE-3 at 0.014.

Layer 2 (Slow cyan layer): a blend of three red sensitized (all with a mixture of RSD-1 and RSD-2) silver iodobromide emulsions: (i) a large sized tabular grain emulsion (1.3×0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; DIR coupler DIR-1 at 0.043; and bleach accelerator releasing coupler B-1 at 0.054.

Layer 3 (Fast cyan layer): a red-sensitized (same as above) tabular silver iodobromide emulsion (2.2×0.128, 4.1 mole % I) at 0.086; cyan coupler C-1 at 0.081; DIR-1 at 0.034; MC-1 at 0.043; and gelatin at 1.72.

Layer 4 (Interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; magenta dye forming coupler A at 0.215; and gelatin at 1.08.

Layer 6 (Mid magenta layer): a blend of two green sensitized (same as above) tabular silver iodobromide emulsions (i) 1.3×0.113, 4.1 mole % I at 0.430 and (ii) 0.54×0.91, 4.1 mole % I at 0.172; Coupler A at 0.081; MC-2 at 0.151; DIR-2 at 0.016; and gelatin at 2.12.

Layer 7 (Fast magenta layer): a green sensitized tabular silver iodobromide (1.8×0.127, 4.1 mole % I) emulsion at 0.689; gelatin at 1.61; Coupler A at 0.048; MC-2 at 0.054 and DIR-3 at 0.003.

Layer 8 (Yellow filter layer): gelatin at 0.86; Carey-Lea silver at 0.043 and OxDS-2 at 0.054.

Layer 9 (Slow yellow layer): an equal blend of three blue sensitized (both with BSD-1) tabular silver iodobromide emulsions (i) 0.50×0.085, 1.5 mole % I (ii) 0.60 diameter, 3% mole I and (iii) 0.68 diameter, 3 mole % I at a total of 0.430; yellow dye forming coupler Y-1 at 0.699; Y-2 at 0.215; DIR-4 at 0.086; C-1 at 0.097 and gelatin at 2.066.

Layer 10 (Fast yellow layer): two blue sensitized (with BSD-1) tabular silver iodobromide emulsions (i) 3.1×0.137, 4.1 mole % I at 0.396 (ii) 0.95 diameter, 7.1 mole % I at 0.47; Y-1 at 0.131; Y-2 at 0.215; DIR-4 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; UV-1 and UV-2 (1:1 ratio) at a total of 0.023 and bis(vinylsulfonyl)methane hardener at 1.6% of total gelatin weight.

Surfactants, coating aids, emulsion addenda, sequestrants, lubricants, matte, antifoggants and tinting dyes were added to the appropriate layers as is common in the art.

This example represents a multilayer color negative film with a pyrazolotriazole magenta image coupler.

EXAMPLE ML-2 (COMPARISON)

Example ML-2 was prepared in a similar manner as Example ML-1, except that Coupler A in layer 5, 6 and 7 was replaced with Coupler C at 0.059, 0.086 and 0.258, respectively. This example represents a multilayer color negative film with a 3-anilino-5-pyrazolone magenta image coupler.

EXAMPLE ML-3 (COMPARISON

Example ML-3 was prepared in a similar manner as Example ML-2, except that Coupler A was added to layer 7 at 0.129 and Coupler C in layer 7 was adjusted to 0.129. This example represents a multilayer film with a mixture of 3-anilino-5-pyrazolone and pyrazolotriazole couplers in the least sensitive magenta layer.

EXAMPLE ML-4 (COMPARISON)

Example ML-4 was prepared in a similar manner as Example ML-2, except that Coupler B was added to layer 7 at 0.258 and Coupler C in layer 7 was adjusted to 0.129. This example represents a multilayer film with a mixture of 4 equivalent 3-acylamino-5-pyrazolone and 3-anilino-5-pyrazolone couplers in the least sensitive magenta layer. Note that the laydown of Coupler B is twice that of Coupler A in Example ML-3.

EXAMPLE ML-5 (COMPARISON)

Example ML-5 was prepared in a similar manner to Example ML-2, except that Coupler D was added to layer 7 at 0.258 and Coupler C in layer 7 was adjusted to 0.129. This example represents a multilayer film with a mixture of 4 equivalent 3-acylamino-5-pyrazolone and 3-anilino-5-pyrazolone couplers in the least sensitive magenta layer. Note that the laydown of Coupler D is twice that of Coupler A in Example ML-3.

EXAMPLE ML-6 (INVENTION)

Example ML-6 was prepared in a similar manner as Example ML-2, except that HCC-2 was added to layer 7 at 0.129 and Coupler C in layer 7 was adjusted to 0.129. This example represents a multilayer film with a 1-phenyl-3-acylamino-4-nitrogenheterocycle-pyrazolin-5-one coupler in the least sensitive magenta layer. Note that the laydown of Coupler B is the same as that of Coupler A in Example 3 and half that of Couplers B or D in Examples ML-4 and -5.

EXAMPLE ML-7 (INVENTION).

Example ML-7 was prepared in a similar manner as Example ML-2, except that HCC-1 was added to layer 7 at 0.129 and Coupler C in layer 7 was adjusted to 0.129. This example represents a multilayer film with a mixture of 1-phenyl-3-acylamino-4-nitrogenheterocycle-pyrazolin-5-one coupler and 3-anilino-5-pyrazolone couplers in the least sensitive magenta layer.

Samples of each element were exposed imagewise in all three colors through a stepped density test object and subjected to the KODAK FLEXICOLOR (C41) process as described in *British Journal of Photography Annual,* 1988, pp 196–198. Density, pH sensitivity and photographic measurements were made as described for the single layer elements. In order to compare the latitude (ability of a film to maintain linear density response over an exposure range), the differences between the green densities at +0.15 above Dmin ("low" density), +0.6 above Dmin ("mid" density) and at +1.4 above Dmin ("high" density) between each example and Example ML-1, which has excellent latitude, were made. These differences are labelled as Δ(low, mid, and high) in TABLE IV. In order for a photographic element to have good latitude, these differences should be consistent across the exposure range. In other words, if these differences are small in magnitude (whether positive or negative), then it is an indication that the example has similar latitude to Example 1, a film with excellent latitude. If the differences are, for example, all positive of roughly the same magnitude, then it is an indication that the example has similar latitude but higher contrast compared to Example 1. However, if, for example, two of the Δ values are small in magnitude, but the third is large, then it is an indication of poor latitude and non-linear response to exposure. The ΔDmax between developer of pH 10.3 and 9.75 was also determined.

TABLE III shows the improvement in D580/D550 when the 3-acylamino-5-pyrazolone couplers (B,D, HCC-1 and HCC-2) are added to a 5-anilino-5-pyzazolone coupler (C) such that the film would then appear to a printer more like pyrazolotriazole (A). This was confirmed by printer experiments on a KODAK 312 Color printer, which reads significant amounts of density greater than 565 nm, in which Examples ML-3 to -7 were much closer in green response to Example ML-1 (all pyrazolotriazole) than Example ML-2 (all 3-anilino-5-pyrazolone). Note that Coupler D and HCC-2, which differ only in the presence of a pyrazole coupling-off group, produce the same dye after coupling with oxidized developer.

However, TABLE IV demonstrates that only the inventive combination (Examples ML-6 and -7) combines the printer compatibility feature with the ability to maintain film response at high exposures (a deficiency of Examples ML-4 and -5; note that even at twice the laydown of the two equivalent couplers, the four equivalent couplers in Examples ML-4 and -5 fail to give films with sufficient latitude) and low sensitivity to developer pH variations (a deficiency of Example ML-3 as indicated by ΔDmax). Thus, only films of the invention will have excellent photographic properties such as latitude and low pH sensitivity while appearing more like other commercially available films to a wide range of printers (particularly those that read significant amounts of green density above 565 nm).

TABLE III

HUE COMPARISONS IN MULTILAYER FILMS

| Example | Type | Coupler(s) | D580/D550 Low | Medium | High |
|---|---|---|---|---|---|
| ML-1 | Comp | A | .897 | .844 | .874 |
| ML-2 | Comp | C | .800 | .633 | .631 |
| ML-3 | Comp | A/C | .824 | .711 | .735 |
| ML-4 | Comp | B/C | .820 | .696 | .728 |
| ML-5 | Comp | D/C | .814 | .685 | .711 |
| ML-6 | Inv | HCC-2/C | .822 | .700 | .729 |
| ML-7 | Inv | HCC-1/C | .826 | .692 | .717 |

TABLE IV

PHOTOGRAPHIC PERFORMANCE OF MULTILAYERS

| Example | Type | Latitude Δ (Low) | Δ (Mid) | Δ (high) | Δ Dmax* |
|---|---|---|---|---|---|
| ML-1 | Comp | check | Check | check | 1.078 |
| ML-2 | Comp | −.007 | −.014 | .046 | 0.454 |
| ML-3 | Comp | .005 | .004 | .054 | 0.759 |
| ML-4 | Comp | −.011 | −.031 | −.137 | 0.448 |
| ML-5 | Comp | −.013 | −.018 | −.099 | 0.453 |
| ML-6 | Inv | .020 | .023 | .075 | 0.383 |
| ML-7 | Inv | .013 | .015 | .073 | 0.387 |

*Developer pH 10.3 vs 9.75

COUPLER D

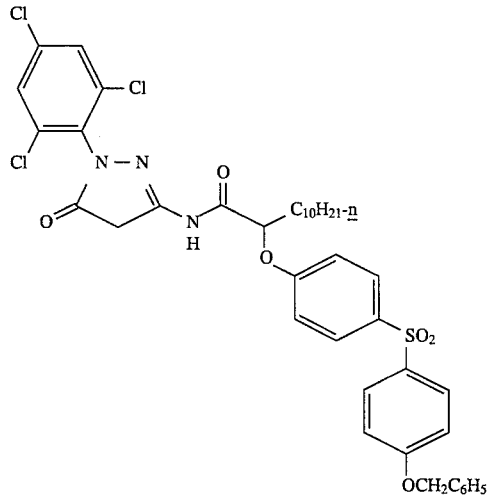

DYE-1:

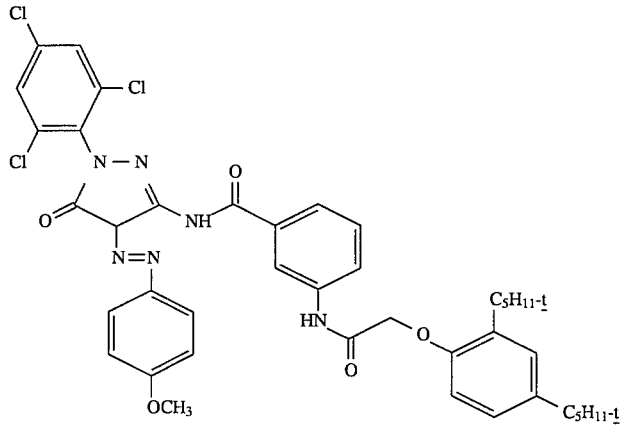

TABLE IV-continued
DYE-2:
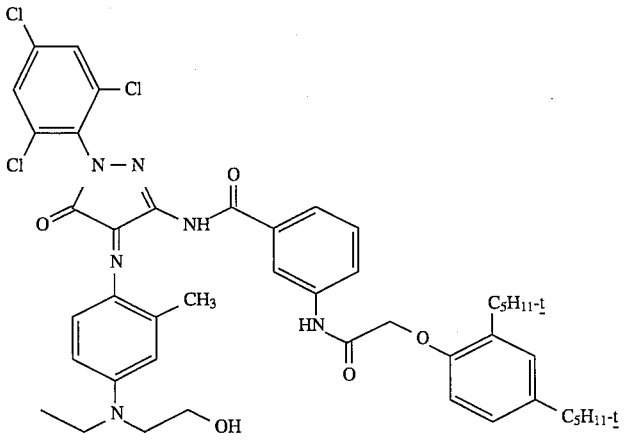
DYE-3:
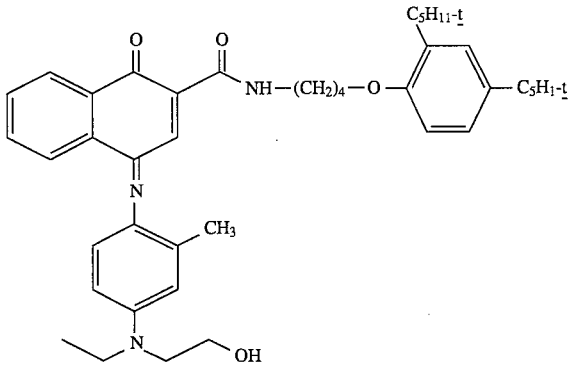
C-1:
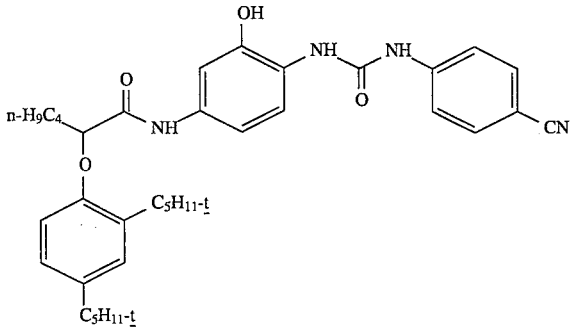
Y-1:
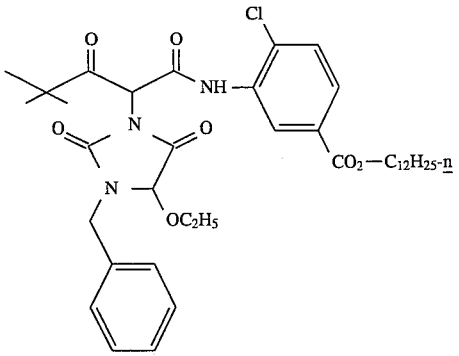

TABLE IV-continued
Y-2:
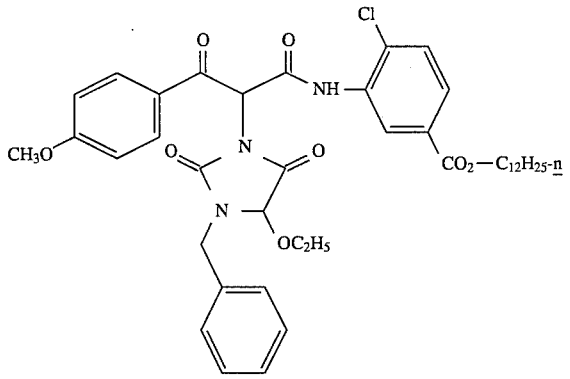
DIR-1:
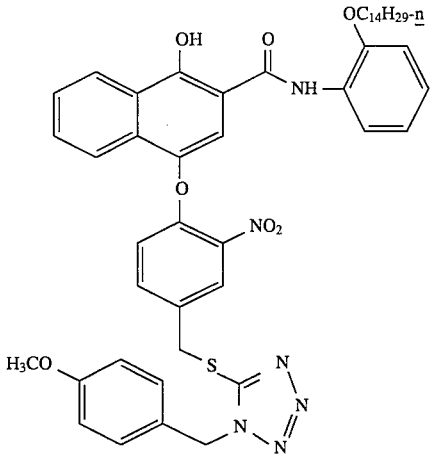
DIR-2:
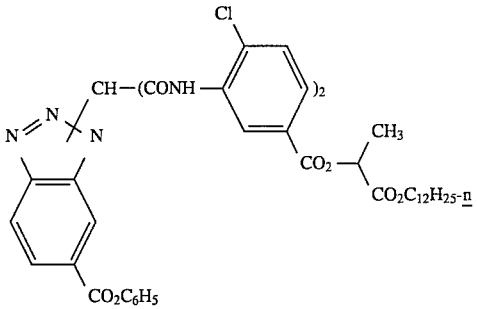
DIR-3:
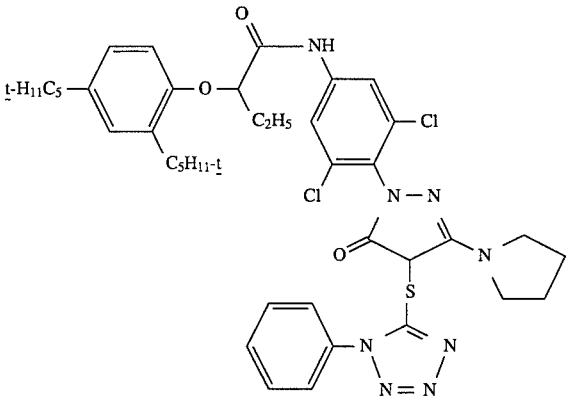

TABLE IV-continued
DIR-4:
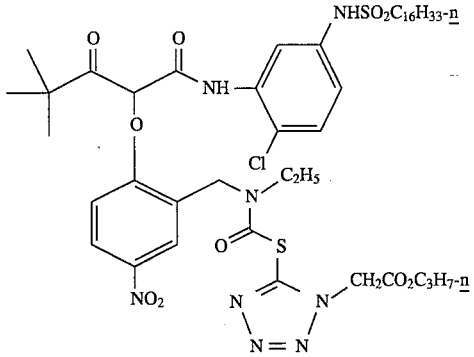
MC-1:
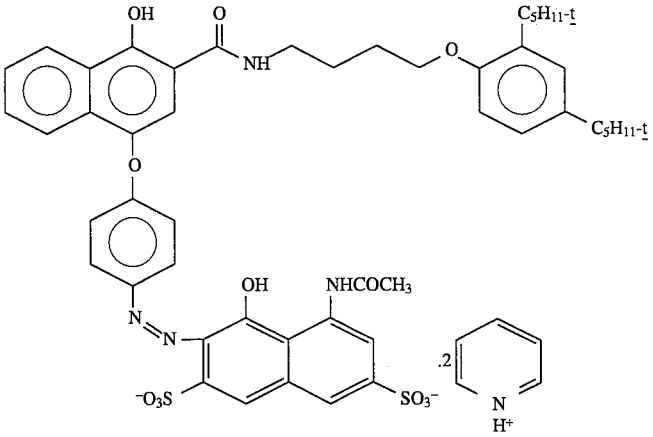
MC-2:
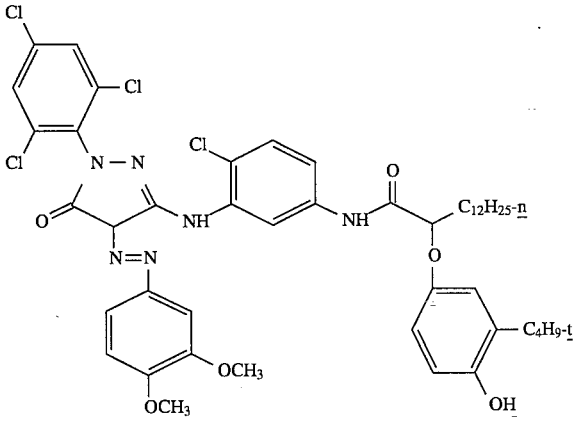
B-1:
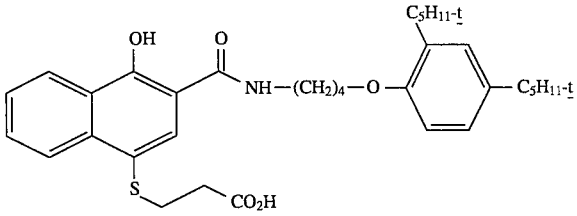
OxDS-1:
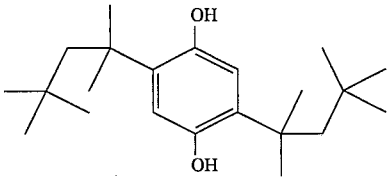

TABLE IV-continued
OxDS-2:
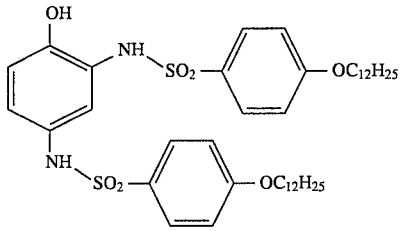
UV-1:
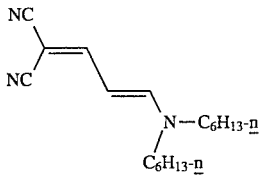
UV-2:
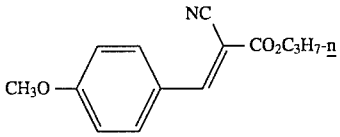
RSD-1
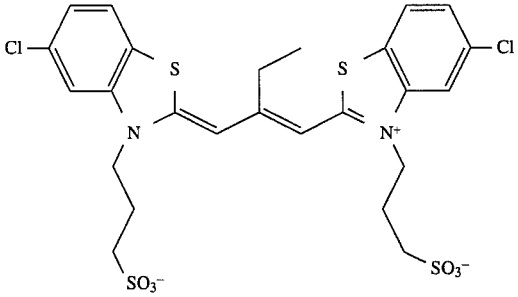
RSD-2:
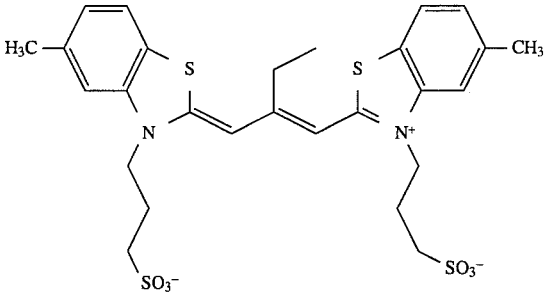
GSD-1:
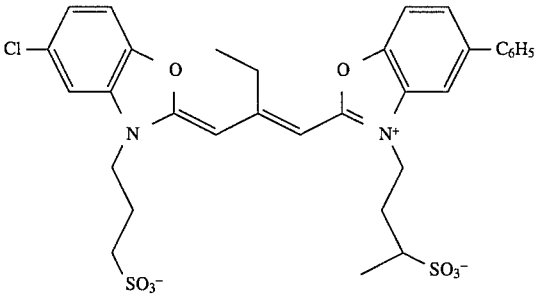

TABLE IV-continued

GSD-2:

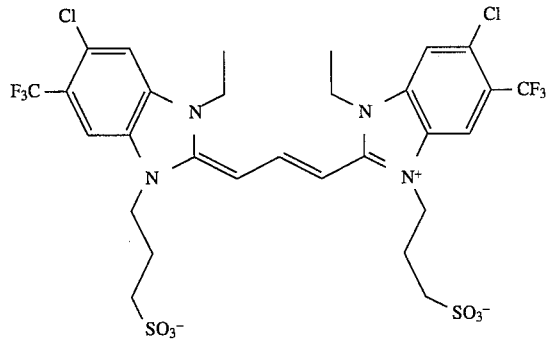

BSD-1:

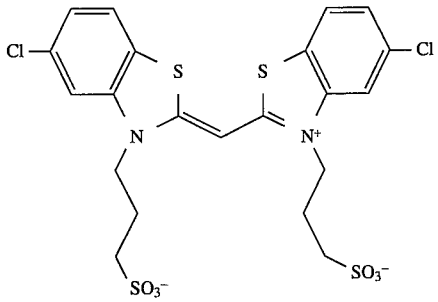

The present invention has been described in detail with particular reference to preferred embodiments, but it will be understood that variations and modifications can be effected within the spirit and the scope of the invention.

What is claimed is:

1. A multicolor negative photographic element comprising a support bearing a cyan dye image-forming unit comprised of at least one red-sensitive silver halide emulsion layer having associated therewith at least one cyan dye-forming coupler, a magenta dye image-forming unit comprising at least one green sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler wherein the magenta dye image-forming unit comprises at least two green light sensitive silver halide emulsion layers of differing light sensitivity, the least and only the least green sensitive layer containing a 1-phenyl-3-acylamino-4-nitrogenheterocyclic-pyrazolin-5-one dye forming hue correction coupler which reacts with oxidized developer during development to form a dye having a maximum absorbance less than 560 nm and a D580/D550 ratio greater than that exhibited by the element absent the hue correction coupler.

2. A multicolor negative photographic element as in claim 1 wherein the D580/D550 ratio of the element absent the hue correction coupler is 0.75 or less at neutral midscale exposure.

3. A multicolor negative photographic element as in claim 2 wherein the D580/D550 ratio of the element absent the hue correction coupler is 0.6 or less at neutral midscale exposure.

4. A multicolor negative photographic element as in claim 3 wherein the D580/D550 ratio of the element absent the hue correction coupler is 0.5 or less at neutral midscale exposure.

5. The element of claim 1 wherein the element containing the hue correction coupler exhibits an increase in the density ratio D580/D550 of at least 0.01 over the same element absent the hue correction coupler.

6. The element of claim 5 wherein the element containing the hue correction coupler exhibits an increase in the density ratio D580/D550 of at least 0.1 over the same element absent the hue correction coupler.

7. The element of claim 1 wherein the density at 580 nm provided by the 1-phenyl-3-acylamino-4-nitrogenheterocyclic-pyrazolin-5-one coupler is between 0.001 and 2.0.

8. The element of claim 7 wherein the density at 580 nm provided by the 1-phenyl-3-acylamino-4-nitrogenheterocyclic-pyrazolin-5-one coupler is between 0.005 and 1.0.

9. The element of claim 1 wherein the structure of the 1-phenyl-3-acylamino-4-nitrogenheterocyclic-pyrazolin-5-one coupler is shown in formula I:

I

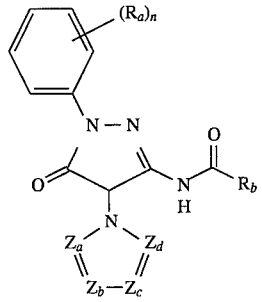

wherein:

each $R_a$ is independently a substitutent selected from the group consisting of halogen, cyano, nitro, and trifluromethyl, and from alkylsulfonyl, sulfamoyl, sulfonamido, carbamoyl, carbonamido, alkoxy, acyloxy, aryloxy, alkoxycarbonyl, aryloxycarbonyl, and ureido groups;

n is and integer from 1 to 5;

$R_b$ is selected from the group consisting of alkyl, alkyloxy, aryl, aryloxy and amino groups;

each of $Z_a$, $Z_b$, $Z_c$, and $Z_d$ are independently a methine group or a nitrogen atom.

10. The element of claim 9 wherein $(R_a)_n$ is 2,5-dichloro or 2,4,6-trichloro;

$R_b$ is a substituted alkyl or aryl group; and $Z_a$ is a nitrogen atom, and $Z_b$, $Z_c$, and $Z_d$ are each unsubstituted methine.

11. The element of claim 1 wherein the hue correction coupler has one of the formulas:

HCC-1:

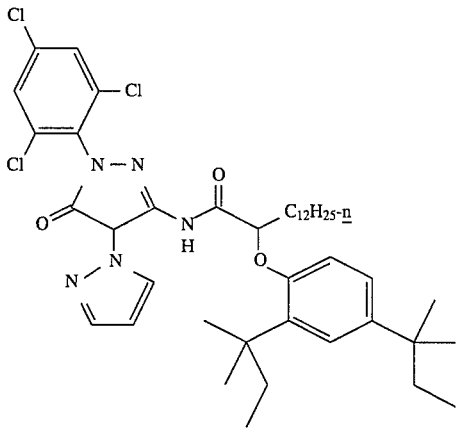

HCC-2:

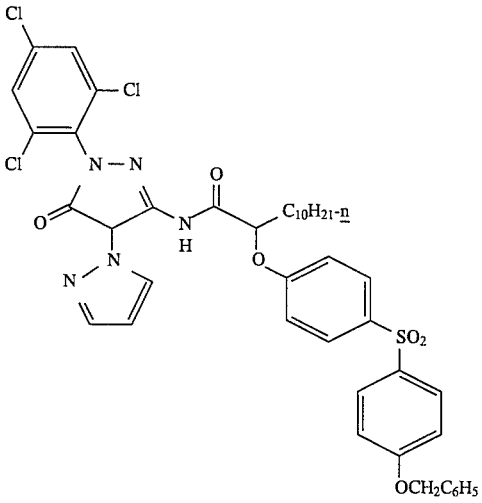

HCC-3:

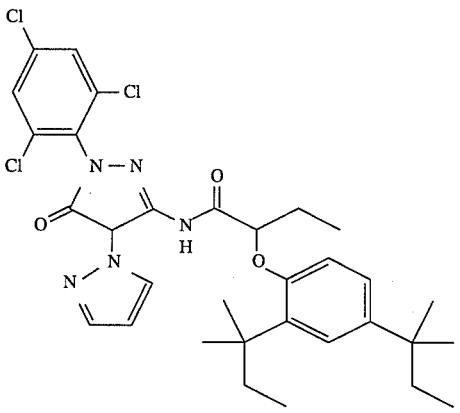

-continued

HCC-4:

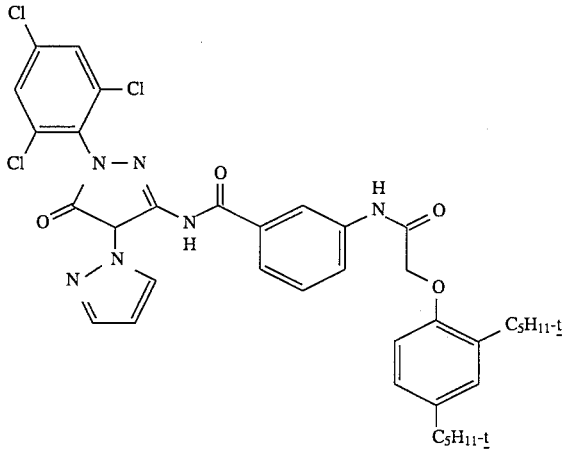

HCC-5:

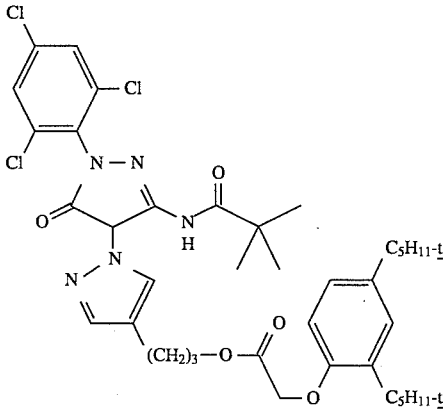

HCC-6:

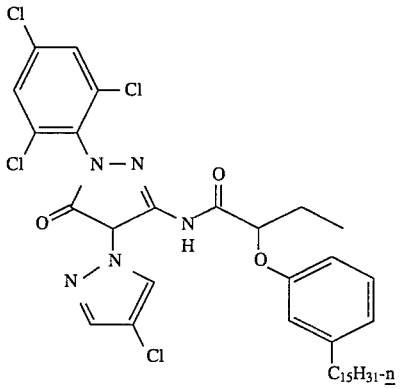

HCC-7:

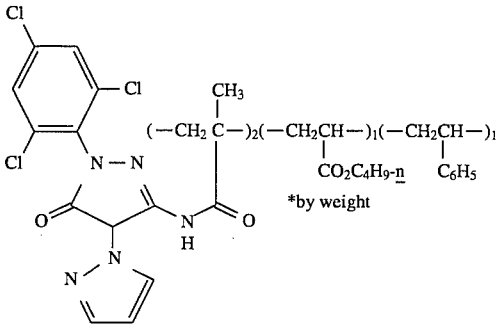

-continued
HCC-8:
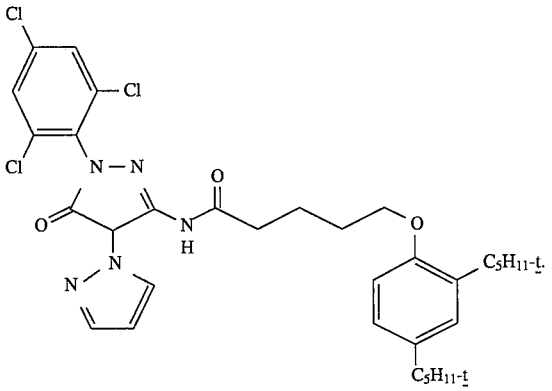
12. A process for forming an image after the exposure of the multicolor negative photographic element of claim 1 to light, comprising contacting the element with a color developing agent.
* * * * *